US012448163B2

(12) United States Patent
Paul

(10) Patent No.: US 12,448,163 B2
(45) Date of Patent: Oct. 21, 2025

(54) LONGITUDINAL NOZZLE ARRANGEMENT

(71) Applicant: GEA Food Solutions Germany GmbH, Biedenkopf-Wallau (DE)

(72) Inventor: Reiner Paul, Dautphetal-Elmshausen (DE)

(73) Assignee: GEA Food Solutions Germany GmbH, Biedenkopf-Wallau (DE)

( * ) Notice: Subject to any disclaimer, the term of this patent is extended or adjusted under 35 U.S.C. 154(b) by 0 days.

(21) Appl. No.: 18/032,611

(22) PCT Filed: Oct. 18, 2021

(86) PCT No.: PCT/EP2021/078779
§ 371 (c)(1),
(2) Date: Apr. 21, 2023

(87) PCT Pub. No.: WO2022/084235
PCT Pub. Date: Apr. 28, 2022

(65) Prior Publication Data

US 2023/0382579 A1 Nov. 30, 2023

(30) Foreign Application Priority Data

Oct. 21, 2020 (DE) ..... 10 2020 213 308.5

(51) Int. Cl.
*B65B 31/04* (2006.01)
*B65B 7/28* (2006.01)
(Continued)

(52) U.S. Cl.
CPC ..... *B65B 31/046* (2013.01); *B65B 7/2878* (2013.01); *B65B 9/04* (2013.01); *B65B 41/12* (2013.01); *B65B 51/14* (2013.01)

(58) Field of Classification Search
CPC ..... B65B 31/02; B65B 31/044; B65B 31/046
See application file for complete search history.

(56) References Cited

U.S. PATENT DOCUMENTS 5,323,590 A 6/1994 Garwood
5,534,282 A 7/1996 Garwood
(Continued)

FOREIGN PATENT DOCUMENTS

DE 29912090 U1 * 9/1999 ..... B65B 31/02
EP 1021338 A1 7/2000
(Continued)

OTHER PUBLICATIONS

International Search Report and Written Opinion dated May 30, 2022, for International Application PCT/EP2021/078779.
(Continued)

*Primary Examiner* — Daniel Jeremy Leeds
(74) *Attorney, Agent, or Firm* — The Dobrusin Law Firm, P.C.

(57) ABSTRACT

A system that includes a longitudinal nozzle arrangement that has a longitudinal extension direction along which a plurality of injection openings and/or evacuation openings are provided and that has a first end and a second end along the longitudinal extension direction; and a ramp is provided at at least one of the first end and the second end, an incline of which extends at least in the longitudinal extension direction; and a seal having a longitudinal extension direction with a first end and a second end, and a ramp is provided at at least one of the first end and the second end, an incline of which extends at least in the longitudinal extension direction.

20 Claims, 2 Drawing Sheets

(51) Int. Cl.

| | |
|---|---|
| ***B65B 9/04*** | (2006.01) |
| ***B65B 41/12*** | (2006.01) |
| ***B65B 51/14*** | (2006.01) |

(56) References Cited

U.S. PATENT DOCUMENTS

| | | | |
|---|---|---|---|
| 2004/0081729 | A1 | 4/2004 | Garwood |
| 2016/0288937 | A1 | 10/2016 | Grether et al. |
| 2018/0251245 | A1 | 9/2018 | Jung et al. |

FOREIGN PATENT DOCUMENTS

| | | | |
|---|---|---|---|
| GB | 965034 | A | 7/1964 |
| JP | S6332103 | U | 3/1988 |
| WO | 99/17990 | A1 | 4/1999 |

OTHER PUBLICATIONS

International Preliminary Report on Patentability dated Jan. 31, 2023, for International Application PCT/EP2021/078779.

* cited by examiner

LONGITUDINAL NOZZLE ARRANGEMENT

CROSS REFERENCE TO RELATED APPLICATIONS

This application is a US national stage of PCT/EP2021/078779 filed on Oct. 18, 2021, which claims priority to DE 10 2020 213 308.5 filed on Oct. 21, 2020, all of which are hereby incorporated by reference herein for all purposes.

FIELD

The present invention relates to a longitudinal nozzle arrangement and to the sealing unit of a packaging machine. Moreover, the present invention relates to a sealing station that connects an upper material web to the lower material web, and relates to a method for producing a packaging.

BACKGROUND

Packaging machines are known from the prior art. In these packaging machines, a material web or packaging tray is filled with a product and this material web/packaging tray is then hermetically sealed with an upper material web in a sealing station. Prior to the sealing, the atmosphere in the packaging is changed with respect to the ambient atmosphere, for example, the pressure in the packaging is reduced and/or a gas differing in composition from air is injected into the packaging. The packaging machine can be a thermoformer or a tray sealer, for example. The substance in the material web may preferably be paper, paperboard, metal, a plastic film, and/or a combination thereof. In the past, changing the atmosphere has frequently resulted in hygiene problems and/or the change in the atmosphere was incomplete and/or undesired folds, wrinkles, or other discrepancies in shape were created on a material web, generally the upper material web, and/or there was increased friction and/or collision when the sealed packaging was transported further, and/or undesired dust was created, in particular during processing of fiber-based material webs, for example during cutting of paperboard.

SUMMARY

It was therefore the object of the present invention to provide a longitudinal nozzle arrangement, a sealing unit, a packaging machine, and/or a method that does not suffer from the drawbacks of the prior art.

The object is attained with a longitudinal nozzle arrangement that has a longitudinal extension direction along which a plurality of injection openings and/or evacuation openings are provided and that has a first end and a second end along the longitudinal extension direction, wherein a ramp, the incline of which extends at least in the longitudinal extension direction, is provided on at least one end.

Information provided regarding the subject matter of the present invention also applies equally to the other subject matters, and vice versa. Features of this subject matter of the present invention can be included in other subject matters and vice versa.

This subject matter of the present invention relates to a longitudinal nozzle arrangement with which a gas, in particular air, between two material webs in a sealing station is evacuated or a gas, in particular an inert gas, such as for example $N_2$ and/or Ar, or $CO_2$ or $O_2$ is injected between the material webs. The material webs can be a paper, paperboard, aluminum, and/or plastic film web. The material webs are transported in a packaging machine along a direction of movement, in particular further transported intermittently, in cycles by a so-called draw length or format length, i.e., a certain material web length. A plurality of packaging trays are preferably molded into the lower material web per cycle, or the material web is left unmolded and filled with the product to be packaged, and then in the sealing station is sealed with the upper material web following the gas exchange described in the foregoing. Such a format has at least one gap, wherein a gap preferably has a plurality of packaging trays arranged transverse to the transport direction of the lower material web. Preferably such a format has a plurality of such gaps that are arranged one after the other relative to the transport direction of the lower material web. In addition, a format preferably has a plurality of rows of packaging trays arranged parallel to the transport direction of the lower material web. It is preferably now provided that the longitudinal nozzle arrangement is arranged in the region of at least one lateral edge, preferably both lateral edges, of the material webs, wherein the longitudinal extension direction of the longitudinal nozzle arrangement extends parallel to the movement direction of the material web. The longitudinal nozzle arrangement has a plurality of openings that are preferably provided adjacent to one another, particularly preferably adjacent to one another in a horizontal plane, relative to the longitudinal extension direction of the longitudinal nozzle arrangement or the movement direction of the material web.

The longitudinal nozzle arrangement preferably has a flat nozzle, the horizontal extension of which is greater transverse to the longitudinal extension direction of the longitudinal nozzle arrangement than its perpendicular extension transverse to the longitudinal extension of the longitudinal nozzle arrangement. The flat nozzle preferably has a plurality of openings that are provided adjacent to one another along the longitudinal extension direction of the flat nozzle. The flat nozzle preferably tapers towards the openings. The lower material web and upper material web are preferably each positioned on opposing sides of the flat nozzle, in particular when a gas is evacuated or injected. Alternatively, a nozzle that is wedge-shaped, at least in sections, can be provided instead of the flat nozzle. The lower material web and upper material web are preferably each positioned on opposing sides of the wedge-shaped nozzle, in particular when a gas is evacuated or injected.

The openings of the longitudinal nozzle arrangement can each be employed for injecting gas and/or evacuating gas, in particular air. The gas volume flow can preferably be adjusted per opening or a group of a plurality of openings can preferably be adjusted individually independently of the volume flow of the other nozzles. This may be performed manually or automatically. If one longitudinal nozzle arrangement each is arranged laterally to the right and left of the material web in the movement direction, one longitudinal nozzle arrangement can be employed solely for evacuating a gas and one longitudinal nozzle arrangement can be employed solely for injecting a gas. However, it is also preferred that both longitudinal nozzle arrangement are employed for injecting gas into and/or evacuating gas from the packaging.

The length of the longitudinal nozzle arrangement, in particular the flat nozzle, in the longitudinal extension direction preferably essentially corresponds to the straight format produced or the draw length during one cycle. According to one further preferred embodiment, the length of the longitudinal nozzle arrangement, in particular the flat nozzle or wedge-shaped nozzle, in the longitudinal extension direction essentially corresponds to the maximum possible draw length of the material web in one cycle. If the current draw length or the current format is shorter than the maximum possible draw length or the maximum format length, for example, if, instead of the maximum number n gaps, the current draw length or the current format includes only a number n−1 gaps, openings are preferably turned off at one or both end regions of the flat nozzle.

The gas flow in the longitudinal nozzle arrangement is preferably regulatable during gas evacuation and/or injection. This preferably applies to the gas volume flow and/or to the amount of gas. The openings of a longitudinal nozzle arrangement via which gas is introduced and/or evacuated are preferably selectable, individually or as a group of a plurality of nozzles. The gas flow is adjusted and/or the openings are selected preferably via at least one valve, preferably a plurality of valves, preferably provided in the longitudinal nozzle arrangement. The valves are preferably adjusted automatically when there is a production change.

The longitudinal nozzle arrangement preferably has two channels, one for evacuating gas, i.e. for evacuating the packaging, and one for injecting a gas, i.e., supplying gas to the packaging. Both channels can preferably be connected selectively to the openings so that each opening can be employed as desired for evacuating gas and for supplying gas.

The longitudinal nozzle arrangements acts in a particularly advantageous and gentle manner with fiber-based/fiber-containing material webs that contain, for example, components of paper, corrugated cardboard, or paperboard, because the gas is exchanged using the longitudinal nozzle and the gas is not conducted through the material web, as is otherwise conventional, for example through so-called lateral perforation, so that there is no cutting of holes for the lateral perforation in the paperboard, for example, which generates dust, so that less dust, or no dust at all, can make its way into the packaging, and/or cleaning efforts, for example for the tools, can be reduced.

According to the invention, the longitudinal nozzle arrangement, in particular the flat nozzles or wedge-shaped nozzles, have a first, front end and a second, rear end relative to their longitudinal extension direction or the transport direction of the material web. According to the invention, a ramp, the incline of which extends at least in the longitudinal extension direction, is provided on at least one of the two ends. The ramp is preferably provided at the end(s) of the flat nozzle. The longitudinal nozzle arrangement, in particular the flat nozzle, preferably tapers towards the end of the longitudinal nozzle arrangement, in particular the flat nozzle or wedge-shaped nozzle, to achieve, for example, a smooth approximation of the level of the longitudinal nozzle arrangement, especially at the level of the upper tool, so that the tendency to form wrinkles and folds in the material webs is significantly reduced.

The person skilled in the art understands that the incline of the ramp does not have to be linear, but rather may also be curved. A linear incline is preferred, however.

Preferably, on at least one of the two ends at which a ramp is provided, a second ramp is provided, the incline of which preferably extends transverse to the longitudinal extension direction and is preferably overlaid on the first ramp, the incline of which extends in the longitudinal extension direction. The inclines of the two ramps are preferably the same or similar, but may also be at different angles. The inclines of each ramp can be embodied the same across the length of the ramp or different, for example by segment and/or as radii, for example crowned. It is particularly advantageous that a possible edge created at the transition of the two ramps is rounded. Two such ramps form a ramp arrangement.

At least one ramp or ramp arrangement is preferably provided in the region between the front and rear end of the longitudinal nozzle arrangement and/or the flat nozzle and/or the wedge-shaped nozzle, for example in a shorter format having, for example, only n−1 gaps, and the incline of which extends in and preferably also transverse to the longitudinal extension direction. This ramp particularly preferably is opposed by a second ramp in the longitudinal direction, both ramps preferably being spaced apart from one another by a preferably straight segment or no distance being provided, and preferably their tapered ramp ends opposing one another. This second ramp arrangement is disposed in a shorter format outside the format region, that is behind or in front of it, but for example after a subsequent tool change to a format with maximum length, the second ramp is disposed within the format region, just like the first ramp opposing it.

The longitudinal nozzle arrangement, in particular the flat nozzle or wedge-shaped nozzle, has at one end, in particular the front, upstream end, a tongue that preferably extends transverse to the longitudinal extension direction of the nozzle arrangement or flat nozzle. The tongue is preferably exchangeable and/or made of a different material than the rest of the longitudinal nozzle arrangement. The tongue is preferably made of a plastic, particularly preferably an elastic plastic. One possible plastic material is rubber or silicone, for example. The tongue and the rest of the longitudinal nozzle arrangement may also comprise the same material, however, for example aluminum or plastic.

The longitudinal nozzle arrangement is preferably produced, at least in part, by means of layer-wise material application.

On its surfaces, in particular on its bottom side, the flat nozzle has an indentation into which the transport means of the packaging machine can move, in particular the grippers on the chain members.

A further subject matter of the present invention is a sealing unit having a longitudinal extension direction with a first end and a second end, wherein provided on at least one end is a ramp, the incline of which extends in the longitudinal extension direction.

Information provided regarding this subject matter of the present invention also applies equally to the other subject matters, and vice versa. Features of this subject matter of the present invention can be included in other subject matters and vice versa.

According to the invention, the sealing unit has a first, front end and a second, rear end relative to its longitudinal extension direction or the transport direction of the material web. According to the invention, a ramp is provided on at least one of the two ends and its incline extends in the longitudinal extension direction. The sealing unit preferably tapers away from the end of the sealing unit. Preferably, at the at least one of the two ends at which a ramp is provided, a second ramp is provided, the incline of which preferably extends transverse to the longitudinal extension direction and overlays the first ramp, the incline of which extends in the longitudinal extension direction.

At one end, the sealing unit preferably has a ramp that preferably extends transverse to the longitudinal extension direction.

The sealing unit is preferably made of a rubber-like elastic material, for example silicone, and is preferably produced by injection or injection molding.

The sealing unit is preferably provided as a closed structure, i.e., is continuous. The sealing unit is preferably molded or injection molded.

A further subject matter of the present invention is a packaging machine in which, for producing a packaging, a material web is transported along a movement direction and which has a sealing station that connects the material web to an upper material web, wherein the sealing station has the inventive longitudinal nozzle arrangement and/or the inventive sealing unit.

Information provided regarding this subject matter of the present invention also applies equally to the other subject matters, and vice versa. Features of this subject matter of the present invention can be included in other subject matters and vice versa.

This subject matter of the present invention relates to a packaging machine for producing a packaging in which a lower material web, for example a cardboard or paper web, a plastic film, or a material web that in particular has a paperboard, paper, aluminum, or other layer apart from plastic, is rolled off a supply roller and transported, preferably intermittently/in cycles, along the packaging machine in a transport plane. In a molding station this lower film web can then first be molded by means of a thermoforming tool in order to mold, for example, a depression and/or a structure, in particular an anti-slip structure, in the lower material web. As a rule, the molding station has a lower tool and an upper tool that for molding are moved towards one another and for further transport of the lower material web are moved away from one another. The lower tool is disposed below the transport plane for the lower material web and the upper tool is disposed above the transport plane for the lower material web. In the inventive packaging machine, as a rule a plurality of packagings that are arranged in a so-called format are processed simultaneously and then transported simultaneously along the packaging machine. Before and/or during thermoforming, the lower material web is preferably heated with a heating plate. Then the lower material web is filled with a product, in particular a food, such as, for instance, lunch meat, ham, or cheese, and in a next step in a sealing station is sealed with an upper film, wherein as a rule the upper film is sealed to the lower film web. Then the packaging produced in this manner is separated in that the packaging is cut from the lower material web and upper material web. The upper material web is also rolled off of a supply roller. A dancer that keeps the tension in the specific material web at least essentially constant is preferably disposed downstream of at least one supply roller relative to the transport direction of the specific film web. The dancer can be a linear dancer or a rotational dancer.

The packaging can also involve a so-called tray sealer, however, in which the pre-produced packaging shells are filled with a product and then sealed with an upper film.

According to the invention, the sealing station has the inventive longitudinal nozzle arrangement and/or the inventive sealing unit that produces the changed atmosphere, relative to the environment, in the packaging. The pressure in the packaging and/or in the composition of the atmosphere can be changed compared to air. The person skilled in the art is familiar with evacuating and/or supplying gas. The packaging can be evacuated prior to being supplied with gas in order to improve the gas supplying process.

During sealing, the level approximation of the longitudinal nozzle arrangement described above, in particular of its flat nozzle or wedge-shaped nozzle, permits a sharp reduction in, or even complete elimination of, the formation of folds and wrinkles in the material webs, significant improvement in the sealing effect, hygiene, and completeness of the gas exchange. In addition, in particular during further transport of the finished sealed packaging, the risk of the packaging colliding with the longitudinal nozzle arrangement is avoided.

Particularly preferred is a sealing station in which the inventive longitudinal nozzle arrangement develops the sealing effect without it being necessary to use an additional sealing unit made of a rubber-like elastic material.

The inventive longitudinal nozzle arrangement, in particular its flat nozzle or wedge-shaped nozzle, is arranged for evacuating and/or supplying gas between the two material webs. The sealing unit is disposed above the upper material web and presses the latter in a sealing manner against the longitudinal nozzle arrangement during the evacuation or supplying of gas. The lower material web can also be pressed in a sealing manner against the longitudinal nozzle arrangement by means of the lower tool during the evacuation or supplying of gas.

The sealing station of the packaging machine preferably has a lower tool and an upper tool, wherein the lower tool and/or the upper tool are preferably provided to be raisable and lowerable. The upper tool is disposed above the upper material web and the lower tool is disposed below the lower material web. For further transport of the material webs, the upper tool is preferably raised and the lower tool is preferably lowered, so that each has no contact, or reduced contact, with the corresponding material web, so that friction is sharply reduced.

The sealing unit is preferably connected to the upper tool and is raised and lowered therewith. The sealing unit preferably has a spring inserted into a groove in the upper tool, thus reversibly connecting the sealing unit to the upper tool. When lowered, the upper tool presses the sealing unit against the upper material web and the latter against the longitudinal nozzle arrangement, especially the flat nozzle. In this way the sealing unit can reversibly elastically deform.

The longitudinal nozzle arrangement is preferably connected directly or indirectly to a frame of the packaging machine, i.e., is preferably provided location-fast.

A further subject-matter of the present invention is a method for sealing an upper material web to a material web for producing a packaging, wherein by means of a longitudinal nozzle arrangement the atmosphere in the packaging is changed compared to the environment, wherein a sealing unit is positioned against the material web when the atmosphere is changed, and the material webs are further transported following the sealing, and wherein the sealing unit can preferably be raised prior to and/or during the further transport.

Information provided regarding the subject matter of the present invention also applies equally to the other subject matters, and vice versa. Features of this subject matter of the present invention can be included in other subject matters and vice versa.

According to this subject-matter of the present invention, the sealing unit is raised prior to and/or during further transport of the material web. Because of this, there is no contact, or reduced contact, between the upper material web and the sealing unit during the further transport of the material web, in particular the upper material web, so that friction is at least reduced. Once transport of the material web has ended after a cycle, the sealing unit is lowered again and pressed against the upper material web. The sealing unit is preferably lowered prior to and/or during the change in the atmosphere and pressed against the upper material web.

An inventive longitudinal nozzle arrangement and/or the inventive sealing unit are preferably used for changing the atmosphere.

During the changing of the atmosphere, the sealing unit is preferably pressed against the longitudinal nozzle, in particular the ramp of the sealing unit is pressed against the outlet ramp of the longitudinal nozzle arrangement, in particular the flat nozzle.

One further subject-matter of the present invention is a method for sealing an upper material web to a material web for producing a packaging, wherein the atmosphere is changed compared to the environment by means of a longitudinal nozzle arrangement, wherein a sealing unit is positioned against the material web during the changing of the atmosphere and the material webs are further transported following the sealing, in which the longitudinal nozzle arrangement develops the sealing effect without it being necessary to use an additional sealing unit made of a rubber-like elastic material.

Information provided regarding the subject matter of the present invention also applies equally to the other subject matters, and vice versa. Features of this subject matter of the present invention can be included in other subject matters and vice versa.

This preferred or inventive embodiment of the present invention has the advantage that the required sealing effect is obtained using the longitudinal nozzle in conjunction with the material web.

The following information applies for all embodiments of the present invention.

The gas flow entering the sealing tool or evacuated from the sealing tool using the injection openings and/or evacuation openings is adjustable, in particular individually adjustable. This adjustment can be made manually or by motor. The goal of the adjustment is preferably that the gas volume flow rate when injecting and/or evacuating gas is at least essentially equal in all openings.

The openings from which gas outlets or through which gas is evacuated, and the gas lines connected thereto, in particular those provided in the longitudinal nozzle, are preferably separate from one another. This results in advantages in hygiene.

Preferably a valve is provided both in the gas line to which the injection openings are connected and the gas line to which the evacuation openings are connected, and each said valve can be used in particular to open and close the respective line. Each valve is preferably spaced apart from the openings to which it is connected.

When evacuating gas from the sealing tool, a negative pressure is also applied to the gas volume in the injection line, disposed between the valve and the openings. The resulting gas flow draws any impurities present out of the injection line, so that the latter is cleaned. When the gas is injected into the sealing tool, the gas volume in the evacuation line between the opening and the valve is compressed, so that impurities possibly present therein are moved away from the evacuation opening and pressed into the line and thus do not travel into the packaging to be produced.

The invention is explained in the following using FIGS. 1 through 3. These explanations are merely by way of example and do not limit the general inventive idea. The explanations apply equally for all subject-matters of the present invention.

DETAILED DESCRIPTION

Figure 1:
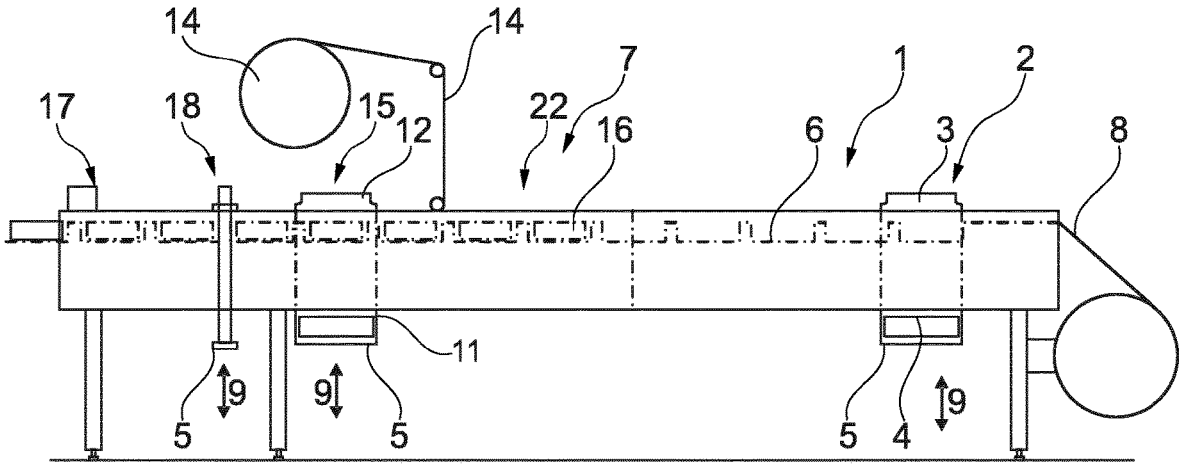
FIG. 1 illustrates the inventive packaging machine.

FIG. 1 illustrates the inventive packaging machine 1, which optionally has a molding station 2, a filling station 7, and a sealing station 15. The packaging machine can be a so-called thermoformer or a so-called tray sealer. A lower material web 8, in this case a plastic film 8, is drawn from a supply roller and transported in cycles from right to left along the inventive packaging machine. The lower material web 8 is intermittently further transported by one format length/draw length in each cycle. To this end, the packaging machine has two transport means 21, in the present case two continuous chains, arranged to the right and left of the lower material web 8. A gear wheel for each chain is arranged both at the beginning and at the end of the packaging machine for reversing each chain. At least one of these gear wheels is driven. The gear wheels in the inlet region and/or in the outlet region can be connected to one another, preferably using a rigid shaft. Each transport means 21 has a plurality of clamping means/grippers 22 that clampingly grip the lower material web 8 in the inlet region and transmit the movement of the transport means to the lower material web 8. The clamping connection between the transport means and the lower material web 8 is released in the outlet region of the packaging machine. A heating means that heats the lower material web 8, in particular when the latter is stationary, can be provided downstream of the inlet region. The optional molding station 2 has a lower tool 4 and an upper tool 3. As the double arrow indicates, the lower tool 4 can be moved upward and downward, wherein it is moved upward towards the lower material web 8 for molding and is moved downward for further transporting the lower material web 8. In the raised position, the lower material web is preferably clamped between the two tools 3, 4. The lower tool 4 can be arranged on a lifting table 5 that is vertically displaceable, as indicated by the double arrow, in order to produce the above-described movement of the lower tool. During the further course of the packaging machine, the indicated packaging trays 6 molded into the lower material web or the lower material web 8 is then filled with the product 16 to be packaged in the filling station 7. An upper film 14 is bonded to the lower material web 8 by sealing in the following sealing station 15, which also comprises an upper tool 12, likewise vertically displaceable, and a lower tool 11, likewise vertically displaceable. In this way movement of the lower material web 8 is transferred to the upper material web 14. The upper tool and/or selectively the lower tool is lowered or raised before and after each film transport in the sealing station, as well. The upper film 14 can be guided in transport means or transported by transport chains, wherein these transport means then extend only before the sealing station and, possibly, upstream. Otherwise the information regarding the transport means of the lower film apply. The upper film can also be heated with a heating means and/or thermoformed. For the sealing, a sealing frame that per packaging tray has one opening into which the possibly present packaging tray dips during sealing, i.e., during the upward movement of the lower sealing tool, can be provided as the lower tool 11, for example. For sealing, the upper material web and the lower material web are pressed together between the upper tool 12 and lower tool 11 and bond to one another with the addition of heat and pressure. After this sealing, the tools 11, 12 are moved vertically apart from one another again. A dancer, for example a rotational dancer, that keeps the material web 14 as much as possible at a constant tension, can be provided between the supply roller for the upper material web 14 and the sealing tool. The person skilled in the art will understand that a dancer is preferably also provided in the region of the lower material web 8, preferably downstream of the supply roller. The dancer is preferably a linear dancer. A gas exchange preferably occurs in each packaging tray prior to and/or during the sealing of the upper material web to the lower material web. For this, some of the air present in the packaging tray can first be evacuated and/or replaced with an exchange gas. The packaging machine has the longitudinal nozzle arrangement explained in greater detail in FIGS. 2-3 for this. During the further course of the packaging machine, the finished packagings are separated, which is accomplished, e.g., with the cross cutter 18 and the longitudinal cutter 17. The cross cutter 18 in this case can also be raised and lowered with a lifting device 9. In accordance with one further embodiment, the sealing tool 11, 12 has a punch that separates the lower material web and the upper material web during and/or after the sealing. A plurality of packagings that are arranged as a matrix in a so-called format are preferably produced simultaneously in each cycle.

Figure 2:
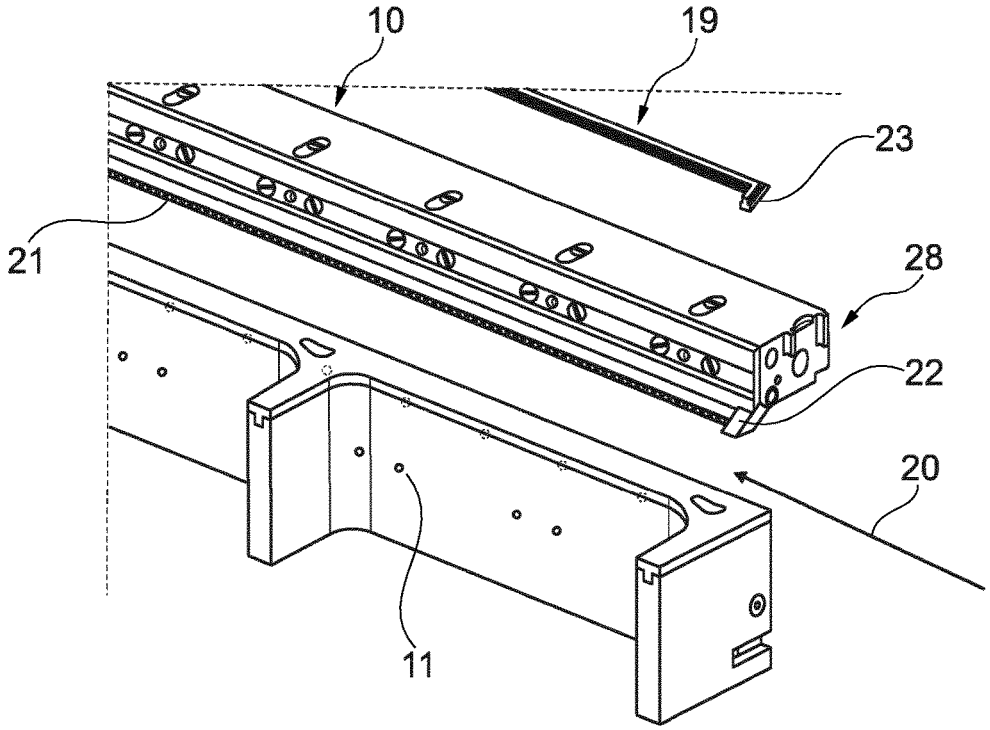
FIGS. 2-3 Illustrate details of the seal, nozzle arrangement, and/or sealing station.
Figure 3:
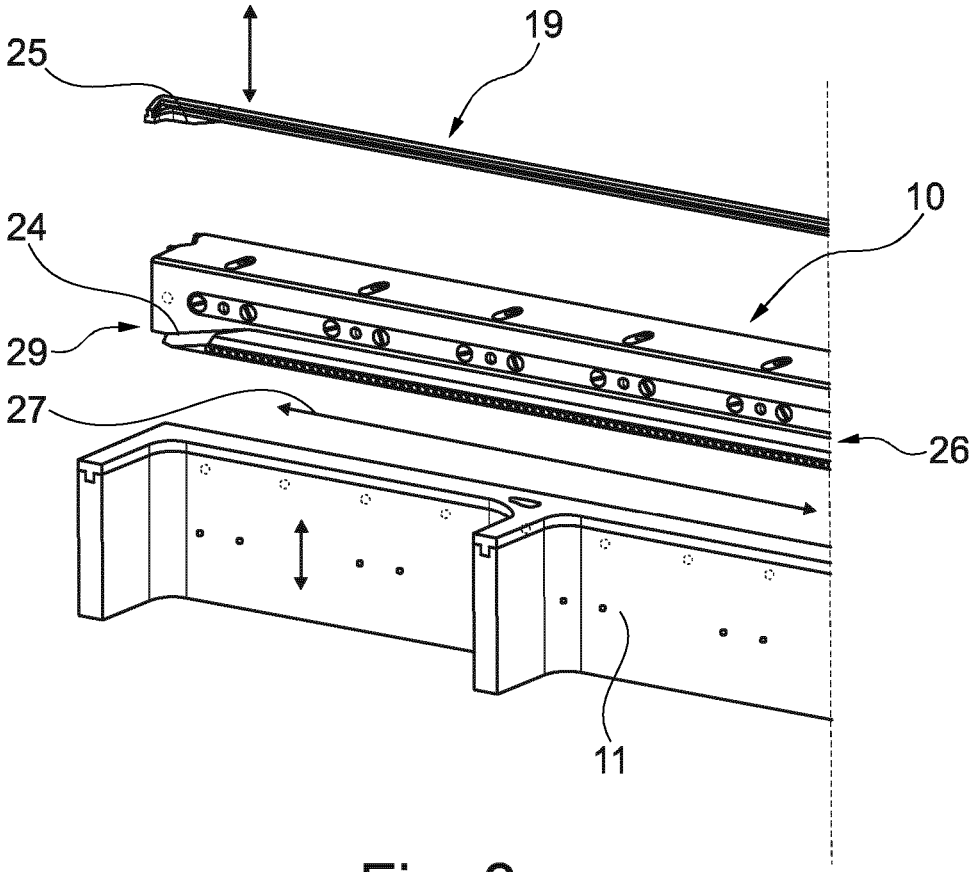

FIGS. 2 and 3 each illustrate the longitudinal nozzle arrangement 10, the sealing unit 19, and the lower tool 11 on one side, in this case the right side, of the material web. The arrow 20 shows the transport direction of the material web. FIG. 2 illustrates the first end 28 of the longitudinal nozzle arrangement 10 or of the sealing unit 19, otherwise called the inlet side, relative to the transport direction 20 of the material web. This end is the upstream end relative to the transport direction 20 of the material web. FIG. 3 shows the second end 29 of the longitudinal nozzle arrangement 10 or of the sealing unit 19, otherwise called the outlet side, relative to the transport direction 20. This end is the downstream end relative to the transport direction 20 of the material web. The person skilled in the art understands that a longitudinal nozzle arrangement can also be provided on the other edge of the material web.

The longitudinal nozzle arrangement has a longitudinal extension direction 27 extending at least essentially parallel to the transport direction 20. Provided along this longitudinal extension direction 27 is a nozzle 26 having a plurality of openings 21, arranged adjacent to one another here. The openings 21 can be employed selectively for evacuating air from one or more packagings and/or for injecting an inert gas. For this, the longitudinal nozzle arrangement has one or more valves. With this/these or with one or a plurality of other valves, the gas volume flow can also be adjusted when gas is evacuated and/or injected and/or the gas quantity is adjusted. All or some of the valves can be adjusted manually or automatically. The length of the longitudinal nozzle arrangement in the longitudinal extension direction can essentially equal the draw length of the format currently being produced. However, it is also possible to provide a longer longitudinal nozzle arrangement length and to shut off openings in the inlet region 28 and/or in the outlet region 29 by means of the valve(s). In the present case, the nozzle 26 is embodied as a flat nozzle, i.e., its horizontal extension transverse to the longitudinal extension direction 27 is greater, preferably substantially greater, than its vertical extension transverse to the longitudinal extension direction 27. In the present case the flat nozzle tapers in the direction of the openings. When a gas is evacuated from and/or injected into the format of packagings, the flat nozzle extends between the upper material web 14 and the material web 8, wherein the material web 8 relative to the vertical contacts the flat nozzle from below and the material web 14 contacts the flat nozzle from above.

For evacuating and or supplying gas, the openings 21 can preferably be controlled individually, particularly preferably by group. If there are two longitudinal nozzle arrangements 10, one to the right and one to the left of the material web, one longitudinal nozzle arrangement can solely evacuate gas and one nozzle arrangement can solely draw off gas.

As can be seen in particular in FIG. 2, the flat nozzle is limited on the inlet side by a tongue 22 extending in this case transverse to the longitudinal extension direction 27 of the longitudinal nozzle arrangement. The tongue 22 is preferably a separate component connected to the longitudinal nozzle arrangement. The tongue is preferably made of an elastic plastic material and is preferably exchangeable.

FIG. 3 illustrates that the longitudinal nozzle arrangement, in this case the flat nozzle, has on its outlet-side end 29 a ramp 24 that tapers in the running direction 20 of the material web or towards its outlet-side end. The ramp 24 can be integrally connected to the flat nozzle or can be provided as a separate component. The ramp extends parallel to the longitudinal extension direction of the longitudinal nozzle arrangement or parallel to the transport direction of the material web 8, 14.

The person skilled in the art will recognize that the tongue 22 can also be replaced by a ramp 24, the height of which increases in the running direction relative to the material web until it has reached the height of the flat nozzle.

In the packaging machine, the longitudinal nozzle arrangement 10 is preferably connected to the frame of the packaging machine, specifically preferably such that the flat nozzle 26 is disposed above the transport means, in particular the chain with the grippers. For this, the flat nozzle is preferably embodied concave on its underside, at least in sections, so that the grippers partially project into this concavity.

Also depicted in FIGS. 2 and 3 is the inventive sealing unit 19, which, as can be seen in particular in FIG. 3, in the outlet region has an outlet incline 25, which is embodied here as a ramp and is preferably provided in a manner complementary to the ramp 24 of the longitudinal nozzle arrangement. The outlet incline 25 extends parallel to the transport direction of the material web. The outlet incline forms a transition region between a thinner region of the sealing unit that extends parallel to the transport direction of the material web or above the flat nozzle and a thick region that extends transverse to the transport direction of the material web or transverse to the flat nozzle 26.

FIG. 2 depicts the inlet region of the sealing unit 19. An inlet incline 22 extending transverse to the transport direction of the material web is provided in this region. The inlet incline 23 forms a transition region between a thinner region of the sealing unit, which extends parallel to the transport direction of the material web or above the flat nozzle, and a thick region, which extends transverse to the transport direction of the material web or transverse to the flat nozzle 26.

If the longitudinal nozzle arrangement also has a ramp in the inlet region, this region of the sealing unit is embodied analogous to the incline 25.

As shown by the double arrow in FIG. 3, the sealing unit can preferably be raised and lowered. For this, the sealing unit 19 is preferably connected to an upper tool 12 that is raised and lowered.

The sealing unit 19 is preferably embodied as a closed form, in particular as a closed rectangle or square, that extends around a packaging or a format of packagings.

FIGS. 2 and 3 also depict a lower tool 11 that functions as a counterbearing during the sealing process and can have cavities for the packagings. This tool can be selectively raised and lowered as indicated by the double arrow.

The inventive method is carried out as follows. One packaging or one material web 8 having one or a plurality of packaging trays is introduced into the sealing station, for example using cyclic transport of the material web 8. The packaging or the material web 8 is then disposed below the flat nozzle 26 and above the lower tool 11. The upper material web 14 that is sealed to the packaging or material web 8 is disposed above the flat nozzle 26. Then the sealing unit 19 is lowered and presses the upper material web against the flat nozzle 26 or against the lower tool 11. Preferably simultaneously the lower tool 11 is raised and presses the material web 8 against the flat nozzle 26 or against the sealing unit 19. Because of this, a closed at least essentially gas-tight region that can now be evacuated or supplied with gas by means of one or a plurality of longitudinal nozzle arrangements 10 is created between the packaging and the upper material web or between the two material webs 8, 14. As soon as the atmosphere in the packaging has been changed, the upper material web 14 is sealed to the lower material web 8. Then the sealing unit 19 is raised again and the lower tool 11 is lowered and at the same time and/or thereafter the packaging or material webs 8, 14 are further transported.

LIST OF REFERENCE NUMBERS

1 Packaging machine
2 Molding station, thermoforming station
3 Upper tool of molding station, upper tool of thermoforming station
4 Lower tool of molding station, upper tool of thermoforming station
5 Lifting table, support for a tool of the sealing or thermoforming station and/or of the cutting device
6 Support for product to be packaged, packaging tray, lower shell, tray
7 Filling station, placement station
8 Material web, lower material web
9 Lifting device
10 Longitudinal nozzle arrangement
11 Lower tool of sealing station
12 Upper tool of sealing station
13 Separated segment, corner
14 Upper material web, cover material web
15 Sealing station
16 Product to be packaged
17 Longitudinal cutter
18 Cross cutter
19 Sealing unit
20 Movement direction of material web 8, 14
21 Injection/evacuation openings
22 Sealing tongue on the longitudinal nozzle 26
23 Inlet incline of the sealing unit 19
24 Outlet ramp on the longitudinal nozzle 26
25 Outlet incline of the sealing unit 19
26 Flat nozzle
27 Longitudinal extension direction
28 First end of the longitudinal extension direction, inlet side
29 Second end of the longitudinal nozzle arrangement (10), outlet side

The invention claimed is:

1. A system for a packaging machine that includes an upper tool, a lower tool, and a material web, the system comprising:

a longitudinal nozzle arrangement that has a longitudinal extension that extends along or parallel to a transport direction of the material web and along which a plurality of injection openings and/or evacuation openings are provided and that has a first end and a second end along the longitudinal extension; and wherein a ramp is provided at at least one of the first end and the second end, an incline of which extends at least along the longitudinal extension; and a sealing unit having a longitudinal extension that extends along or parallel to the transport direction of the material web and that has a first end and a second end, wherein a ramp is provided at at least one of the first end and the second end of the sealing unit, and an incline of the sealing unit extends at least along the longitudinal extension of the sealing unit; wherein the sealing unit is connected to the upper tool, and the sealing unit is configured to press the material web against the longitudinal nozzle arrangement.

2. The system according to claim 1, wherein the longitudinal nozzle arrangement comprises a tongue at the first end of the longitudinal nozzle arrangement or at the second end of the longitudinal nozzle arrangement that extends transverse to the longitudinal extension of the longitudinal nozzle arrangement.

3. The system according to claim 2, wherein the tongue is made of a plastic, an elastic plastic, rubber, or silicone.

4. The system according to claim 1, wherein the longitudinal nozzle arrangement has at least one valve through which a gas flow is introduced or evacuated.

5. A packaging machine wherein the material web is transported along the transport direction and which has a sealing station that connects the material web to another material web, wherein the sealing station comprises the system according to claim 1.

6. The packaging machine according to claim 5, wherein the material web is a fiber-based/fiber-containing material web and the lower tool and/or the upper tool are configured to be raised or lowered during operation of the packaging machine.

7. A method for changing an atmosphere in a packaging comprising the system according to claim 1.

8. The method according to claim 7, wherein during the changing of the atmosphere an outlet incline of the longitudinal nozzle arrangement is pressed against an outlet ramp of the longitudinal nozzle arrangement.

9. The system according to claim 1, wherein the longitudinal nozzle arrangement has a length that extends at least along an entire length of the lower tool in the transport direction of the material web.

10. The system according to claim 1, wherein the longitudinal nozzle arrangement has a length that extends at least between an upstream end of the lower tool and a downstream end of the lower tool, in the transport direction of the material web.

11. The system according to claim 1, wherein the longitudinal nozzle arrangement has a length that corresponds to a straight format produced by the packaging machine and/or to a draw length of the material web during one cycle of the packaging machine.

12. A system for a packaging machine that includes an upper tool, a lower tool, and a material web, the system comprising:

a longitudinal nozzle that has a longitudinal extension along or parallel to a transport direction of the material web and along which a plurality of injection openings and/or evacuation openings are provided and that has an upstream end and an opposing downstream end along the longitudinal extension, the upstream end of the longitudinal nozzle is located at an upstream end of the lower tool and the downstream end of the longitudinal nozzle located at a downstream end of the lower tool; and wherein a ramp is provided at the upstream end of the longitudinal nozzle and/or at the downstream end of the longitudinal nozzle, an incline of which extends along the transport direction of the material web; and a sealing unit having a longitudinal extension along or parallel to the transport direction of the material web and having an upstream end and an opposing downstream end, the upstream end of the sealing unit is located at the upstream end of the lower tool and the downstream end of the sealing unit is located at the downstream end of the lower tool, wherein a ramp is provided at the upstream end of the sealing unit and/or at the downstream end of the sealing unit, and an incline of which extends along the transport direction of the material web.

13. The system according to claim 12, wherein the ramp is provided only at the downstream end of the longitudinal nozzle, and/or only at the downstream end of the sealing unit.

14. The system according to claim 12, wherein the ramp is provided at the downstream end of the longitudinal nozzle, another ramp is provided at the upstream end of the longitudinal nozzle, another ramp is provided at the upstream end of the sealing unit, and another ramp is provided at the downstream end of the sealing unit.

15. The system according to claim 12, wherein the ramp is provided at the downstream end of the sealing unit and forms a transition region between a thinner region of the sealing unit that extends parallel to the transport direction of the material web or above the longitudinal nozzle and a thicker region of the sealing unit that extends transverse to the transport direction of the material web or transverse to the longitudinal nozzle.

16. The system according to claim 12, wherein the upstream end of the longitudinal nozzle has a tongue that extends transverse to the transport direction of the material web.

17. The system according to claim 16, wherein the tongue is exchangeable and/or made of a different material than the rest of the longitudinal nozzle, wherein the tongue is optionally made of a plastic, an elastic plastic, rubber, or silicone.

18. The system according to claim 12, wherein the sealing unit has a spring inserted into a groove in the upper tool to connect the sealing unit to the upper tool.

19. The system according to claim 12, wherein the sealing unit elastically deforms during operation of the packaging machine.

20. The system according to claim 12, wherein a length of the longitudinal nozzle corresponds to a straight format produced or a draw length of the material web during one cycle of the packaging machine.

* * * * *